US008505653B2

(12) United States Patent
Shoyhetman et al.

(10) Patent No.: US 8,505,653 B2
(45) Date of Patent: Aug. 13, 2013

(54) DOWNHOLE APPARATUS

(75) Inventors: Michael Shoyhetman, Edmonton (CA); David Budney, Edmonton (CA); Craig Budney, Edmonton (CA); Glenn Budney, Edmonton (CA)

(73) Assignee: Lee Oilfield Service Ltd., Edmonton (CA)

( * ) Notice: Subject to any disclaimer, the term of this patent is extended or adjusted under 35 U.S.C. 154(b) by 224 days.

(21) Appl. No.: 12/752,626

(22) Filed: Apr. 1, 2010

(65) Prior Publication Data

US 2011/0240375 A1 Oct. 6, 2011

(51) Int. Cl.
*E21B 4/14* (2006.01)
*E21B 31/113* (2006.01)
*E21B 17/07* (2006.01)

(52) U.S. Cl.
USPC ..... 175/297; 175/300; 175/321; 166/178

(58) Field of Classification Search
USPC ..... 175/296, 297, 300, 321; 166/178, 166/301
See application file for complete search history.

(56) References Cited

U.S. PATENT DOCUMENTS

| | | | | |
|---|---|---|---|---|
| 2,953,352 | A | | 9/1960 | Webb |
| 3,087,559 | A | | 4/1963 | Hazen et al. |
| 3,239,017 | A | | 3/1966 | Hazen et al. |
| 3,353,613 | A | | 11/1967 | Harrison |
| 3,472,326 | A | | 10/1969 | Sutliff et al. |
| 3,539,026 | A | | 11/1970 | Sutliff et al. |
| 3,566,981 | A | | 3/1971 | Love |
| 3,570,612 | A | * | 3/1971 | Slator ..... 175/297 |
| 3,642,069 | A | * | 2/1972 | Adkins ..... 166/301 |
| 3,735,828 | A | | 5/1973 | Berryman |
| 3,815,693 | A | * | 6/1974 | Sutliff et al. ..... 175/232 |
| 3,834,472 | A | * | 9/1974 | Perkins ..... 175/321 |
| 3,955,634 | A | | 5/1976 | Slator et al. |
| 3,963,081 | A | | 6/1976 | Anderson et al. |
| 3,987,858 | A | | 10/1976 | Slator et al. |
| 4,081,043 | A | | 3/1978 | Juergens |
| 4,109,736 | A | | 8/1978 | Webb et al. |
| 4,186,807 | A | | 2/1980 | Sutliff et al. |
| 4,226,289 | A | | 10/1980 | Webb et al. |
| 4,545,444 | A | | 10/1985 | Webb et al. |
| 4,844,157 | A | * | 7/1989 | Taylor ..... 166/178 |
| 4,844,183 | A | * | 7/1989 | Evans ..... 175/296 |
| 4,846,273 | A | | 7/1989 | Anderson et al. |
| 4,865,125 | A | | 9/1989 | De Cuir |

(Continued)

FOREIGN PATENT DOCUMENTS

EP 314130 A1 * 5/1989

*Primary Examiner* — Jennifer H Gay
(74) *Attorney, Agent, or Firm* — Frank J. Dykas; Scott D. Swanson; Dykas & Shaver

(57) ABSTRACT

A double-acting compounder comprises: an outer housing; an inner mandrel disposed telescopically within the outer housing to define a fluid chamber; an equalizer, such as an equalizer piston, between the fluid chamber and an exterior of the outer housing for equalizing pressure; a movable seal assembly within the fluid chamber with a first end defining an end of the fluid chamber; the inner mandrel having an outer shoulder for moving the movable seal assembly with the inner mandrel when the inner mandrel moves in a first direction relative to the outer housing to compresses fluid within the fluid chamber; and the outer housing having an inner shoulder for preventing the movable seal assembly from moving with the inner mandrel when the inner mandrel moves in a second direction relative to the outer housing to compresses fluid within the fluid chamber.

12 Claims, 5 Drawing Sheets

(56) References Cited

U.S. PATENT DOCUMENTS

| | | | | | |
|---|---|---|---|---|---|
| 5,007,479 | A | | 4/1991 | Pleasants et al. | |
| 5,139,086 | A | | 8/1992 | Griffith, Sr. | |
| 5,174,393 | A | | 12/1992 | Roberts et al. | |
| 5,232,060 | A | | 8/1993 | Evans | |
| 5,318,139 | A | | 6/1994 | Evans | |
| 5,411,107 | A | * | 5/1995 | Hailey et al. | 175/296 |
| 5,425,430 | A | | 6/1995 | Roberts | |
| 5,431,221 | A | | 7/1995 | Roberts et al. | |
| 5,447,196 | A | | 9/1995 | Roberts | |
| 5,584,353 | A | | 12/1996 | Chancey et al. | |
| 5,595,244 | A | | 1/1997 | Roberts | |
| 5,595,253 | A | | 1/1997 | Martin et al. | |
| 5,791,420 | A | * | 8/1998 | Budney | 175/296 |
| 5,906,239 | A | | 5/1999 | Oettli | |
| 5,918,688 | A | * | 7/1999 | Evans | 175/57 |
| 5,918,689 | A | | 7/1999 | Roberts | |
| 5,931,242 | A | | 8/1999 | Oettli | |
| 6,202,767 | B1 | | 3/2001 | Friis | |
| 6,328,101 | B1 | * | 12/2001 | Friis | 166/178 |
| 6,481,495 | B1 | | 11/2002 | Evans | |
| 7,451,834 | B2 | * | 11/2008 | Shears et al. | 175/57 |
| 7,753,116 | B2 | * | 7/2010 | Budney et al. | 166/178 |
| 7,905,289 | B2 | * | 3/2011 | Budney et al. | 166/301 |
| 2005/0284665 | A1 | | 12/2005 | Shears et al. | |
| 2009/0301707 | A1 | * | 12/2009 | Budney et al. | 166/178 |
| 2009/0308593 | A1 | * | 12/2009 | Budney et al. | 166/178 |
| 2010/0307739 | A1 | * | 12/2010 | Shoyhetman et al. | 166/178 |
| 2011/0209918 | A1 | * | 9/2011 | Saheta et al. | 175/50 |
| 2011/0240375 | A1 | * | 10/2011 | Shoyhetman et al. | 175/321 |
| 2012/0018144 | A1 | * | 1/2012 | Shoyhetman et al. | 166/178 |

* cited by examiner

DOWNHOLE APPARATUS

TECHNICAL FIELD

This application relates to downhole apparatuses, for example double-acting compounders for coil tubing jars.

BACKGROUND

A downhole apparatus may have contained therein a fluid chamber for a variety of purposes. For example, a compounder used in tandem with a jar may use a fluid chamber as an inner spring mechanism in order to store additional energy used to enhance a jar. U.S. Pat. No. 5,931,242 describes a double-acting compounder that incorporates a movable piston disposed within a fluid chamber between inner and outer cylindrical assemblies to provide compounding in either jarring direction.

SUMMARY

A double-acting compounder is disclosed, comprising: an outer housing; an inner mandrel at least partially disposed telescopically within the outer housing to define a fluid chamber between the inner mandrel and the outer housing, the fluid chamber containing fluid and being sealed at an uphole end and a downhole end; an equalizer between the fluid chamber and an exterior of the outer housing for equalizing pressure; a movable seal assembly disposed within the fluid chamber and having a first end that defines the uphole end or the downhole end of the fluid chamber; the inner mandrel having an outer shoulder for contacting a second end of the movable seal assembly to move the movable seal assembly with the inner mandrel when the inner mandrel moves in a first direction relative to the outer housing to compresses fluid within the fluid chamber; and the outer housing having an inner shoulder for contacting the second end of the movable seal assembly to prevent the movable seal assembly from moving with the inner mandrel when the inner mandrel moves in a second direction relative to the outer housing to compresses fluid within the fluid chamber.

A downhole apparatus is also disclosed, comprising: an outer housing; an inner mandrel at least partially disposed telescopically within the outer housing to define a fluid chamber between the inner mandrel and the outer housing, the fluid chamber containing fluid and being sealed at an uphole end and a downhole end; an equalizer between the fluid chamber and an exterior of the outer housing for equalizing pressure, the equalizer having an extension from the outer housing into the fluid chamber between the downhole end and the uphole end to define a chamber between the extension and the outer housing, the chamber having a port to the wellbore, and an equalization piston disposed within the chamber between the fluid chamber and the port.

A double-acting compounder is also disclosed, comprising: an outer housing; an inner mandrel at least partially disposed telescopically within the outer housing to define a fluid chamber between the inner mandrel and the outer housing, the fluid chamber containing fluid and being sealed at an uphole end and a downhole end; a movable seal assembly disposed within the fluid chamber and having a first end that defines the uphole end or the downhole end of the fluid chamber; the inner mandrel having an outer shoulder for contacting a second end of the movable seal assembly to move the movable seal assembly with the inner mandrel when the inner mandrel moves in a first direction relative to the outer housing to compresses fluid within the fluid chamber; the outer housing having an inner shoulder for contacting the second end of the movable seal assembly to prevent the movable seal assembly from moving with the inner mandrel when the inner mandrel moves in a second direction relative to the outer housing to compresses fluid within the fluid chamber; and in which the double-acting compounder is configured to expose the second end of the movable seal assembly to toolbore pressure in use.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figures 1A, 1B, 1C:
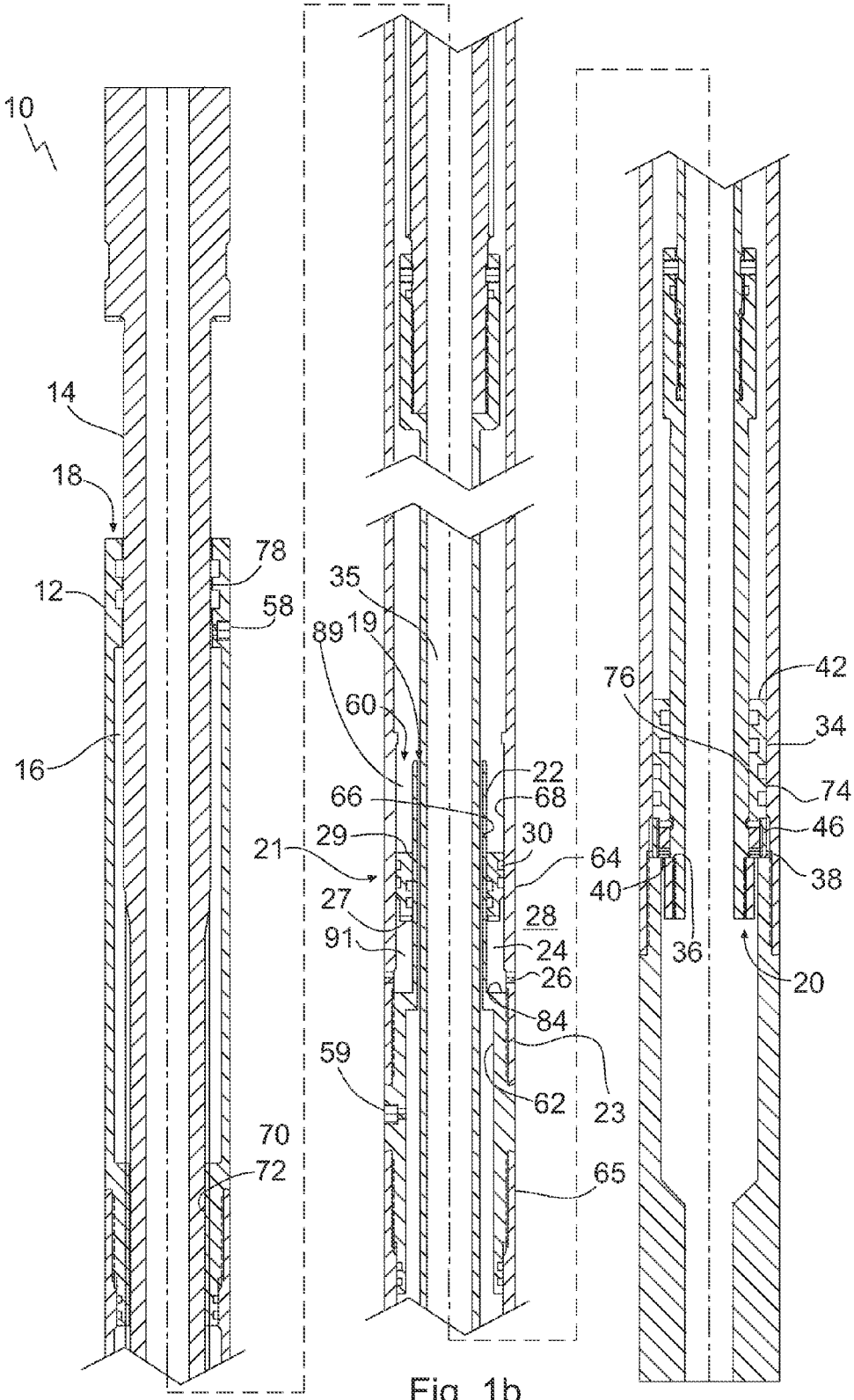
FIGS. 1*a-c* form an exploded side elevation view, in section and not to scale, of a double-acting compounder in a neutral position.

Immaterial modifications may be made to the embodiments described here without departing from what is covered by the claims.

Various components of conventional drill pipe, coil tubing or other downhole tools get stuck in the well bore at times. Jars are used in the oilfield industry to deliver jarring blows in order to free a stuck component, such as a stuck section of pipe. Jars are also used in fishing operations, in order to free an object stuck in a downhole well. Under these circumstances, repetitive upjarring or downjarring with a jarring tool can be useful. Double-acting jars exist that are capable of performing this function.

Adapting a jar and compounder assembly to a coil tubing application presents some challenges to overcome. A coil tubing operation may involve a continuous pipe or tubing, which is uncoiled from a reel as it is lowered into the well bore, and can be used in drilling or workover applications for example. However, coil tubing presents a number of working constraints to the design of a tool. First of all, due to the limited strength of the coil tubing, limited compressive loads can be placed on the tubing by the rig operator. Essentially, this means that downhole tools that require compressive force to operate, such as a jarring tool, must be capable of operating with the limited compressive load capability of coil tubing. In addition, in coil tubing applications the overall length of the downhole tool becomes significant since there is limited distance available at the wellhead, for example between the stuffing box and the blowout preventor, to accommodate the bottom hole assembly. A typical bottom hole assembly may include additional tools, for example, a quick disconnect, a sinker bar, a release tool of some type, and an overshot. Thus, the length of the jar or compounder itself becomes particularly significant since the entire bottom hole assembly may be required to fit within the limited distance between the stuffing box and blowout preventor to introduce it into a pressurized well. Furthermore, within these confines, the jar and compounder assembly may be required to have a large enough internal bore to permit pump-down tools to pass. Thus, coil tubing jar and compounder assemblies may have a limited overall wall thickness in view of limited outer diameter conditions.

A double-acting compounder may be used with a double-acting jar, in order to compound the jarring force of the jar in both directions. The compounder may be connected, for example, either directly or indirectly to the jar in the tubing string. By applying a compressive or tensile force to the tubing string, the compounder uses, for example, a fluid or mechanical spring to allow additional force to be built up prior to the release of that force in either an up or a down jar. Compounders are useful additions to, for example, a coil tubing jarring operation, because they allow additional force to be built up and stored in the compounder to be transferred during a jarring operation, without imposing additional strain on the already limited stress of the tubing string itself.

Referring to FIGS. 1*a-c*, a downhole apparatus 10 is illustrated, comprising an outer housing 12 and an inner mandrel 14. Inner mandrel 14 is at least partially disposed telescopically within outer housing 12 to define a fluid chamber 16 between the inner mandrel 14 and the outer housing 12, the fluid chamber 16 containing fluid and being sealed at an uphole end 18 and a downhole end 20. Apparatus 10 may be a compounder, for example as shown. The fluid contained within fluid chamber 16 is compressible, for example hydraulic liquid such as compressible silicon fluid. In the case of a compounder, the fluid may create a fluid spring within chamber 16, in which compounding energy may be stored to enhance the jarring impact.

Referring to FIGS. 1*a-c*, apparatus 10 may have an equalizer 21 between the fluid chamber 16 and an exterior 23 of the outer housing 12 for equalizing pressure. Equalizer 21 may comprise an equalization piston 30, which is configured to be exposed to wellbore pressure on one side 27 and pressure from fluid chamber 16 on the other side 29 so that equalization between the two fluids can occur in the presence of a pressure differential across piston 30. Equalizer 21 may also comprise an extension 22 from outer housing 12 into the fluid chamber 16 between the downhole end 20 and the uphole end 18. Extension 22 defines a chamber 24 between the extension 22 and the outer housing 12, and chamber 24 has a port 26 to the wellbore 28. Equalization piston 30 is disposed within the chamber 24 between the fluid chamber 16 and the port 26. The piston 30 divides chamber 24 into an equalization chamber 89 that connects to fluid chamber 16, and a hydrostatic chamber 91 that connects to exterior 23. Thus, as apparatus 10 is lowered into the well and well pressure is exerted upon piston 30 through port 26, piston 30 may travel along extension 22 in order to equalize the pressure between the wellbore and fluid in fluid chamber 16. Equalization eliminates the risk of tool collapse downhole. More than one equalizer 21 may provided with apparatus 10. The provision of extension or nose 22 allows equalizer 21 to be positioned at an intermediate location in fluid chamber 16 between uphole and downhole ends 18 and 20 and thus gives apparatus 10 an equalization function with less tool required length than if piston 30 was situated at one of ends 18 or 20 without extension 22. This is because if piston 30 is positioned at one of ends 18 and 20, the size of the piston 30 is restricted because of the O.D. of the inner mandrel 14 and thus piston 30 must move a greater distance to equalize than if piston 30 was positioned in chamber 24, where a piston 30 with a larger surface area on the side 27 exposed to hydrostatic pressure may be used. Equalization in the context of a compounder also affords smoother operation, which extends seal life and also allows more efficient use of the compounder over the stroke length. In some embodiments, equalizer 21 may be positioned at one of ends 18 or 20, with piston 30 situated between inner mandrel 14 and outer housing 12.

Figure 2A:
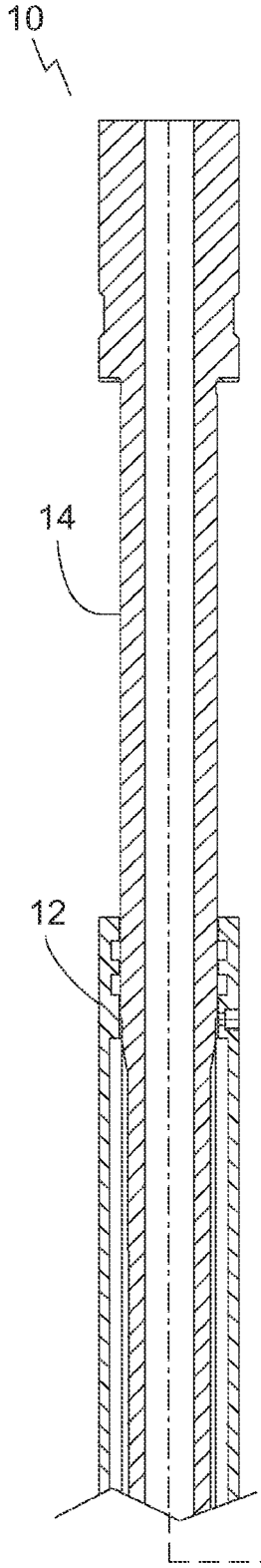
FIGS. 2*a-c* form an exploded side elevation view, in section and not to scale, of a double-acting compounder extended.
Figure 2B:
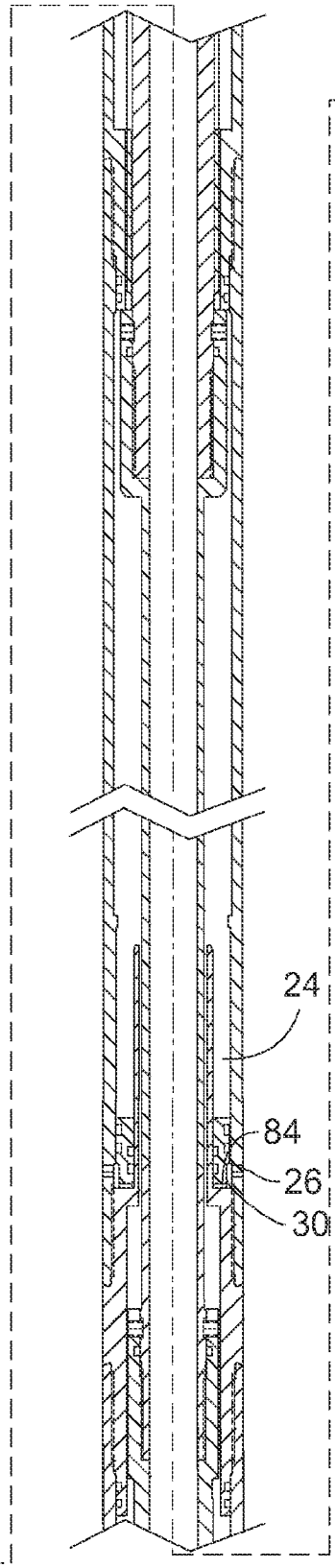
Figure 2C:
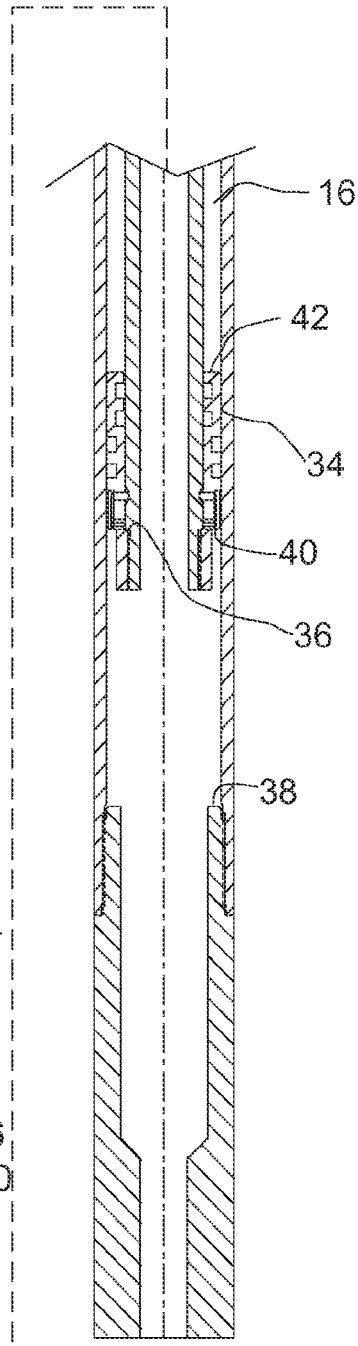
Figures 3A, 3B, 3C, 7, 9:
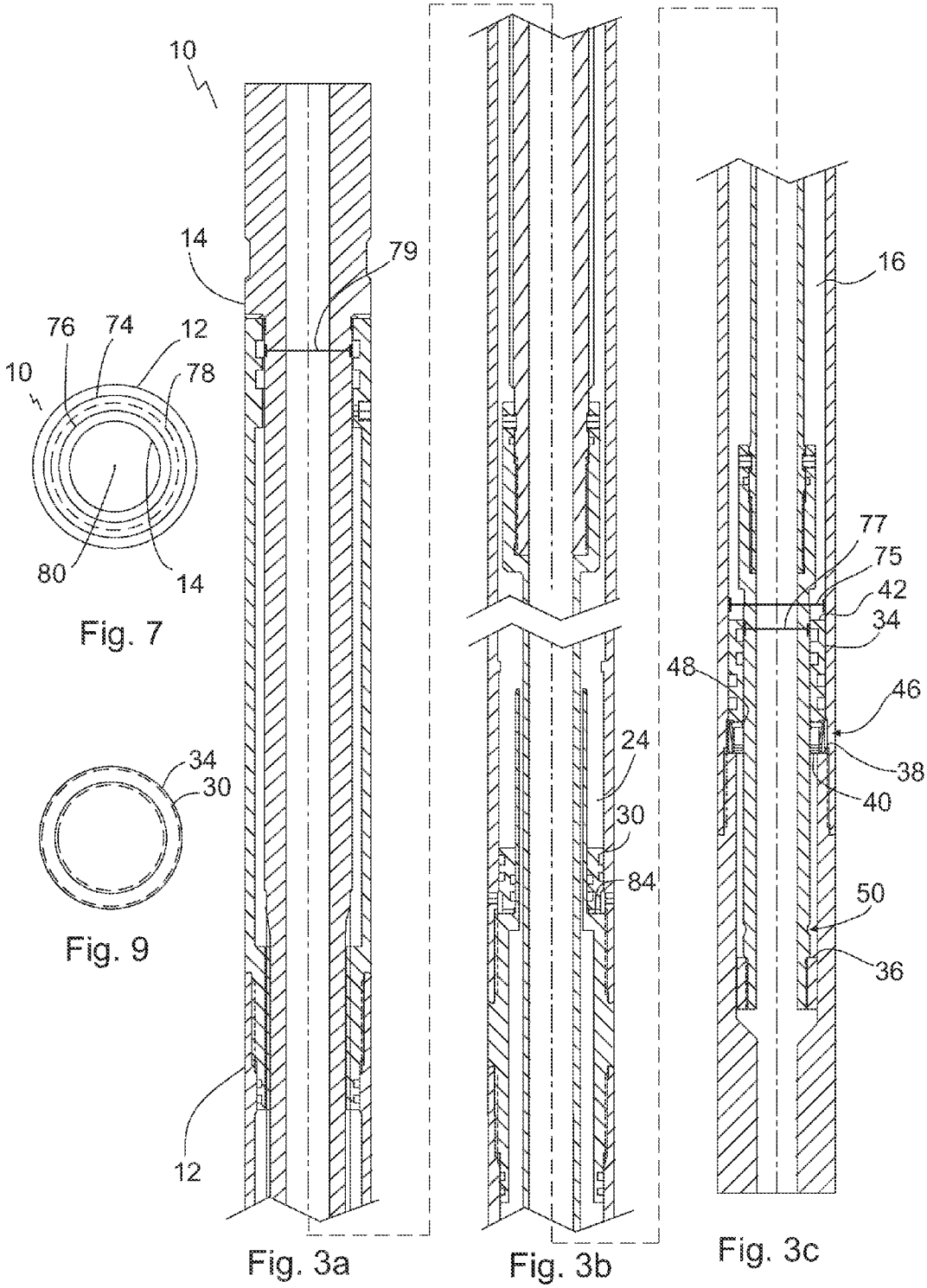
FIGS. 3*a-c* form an exploded side elevation view, in section and not to scale, of a double-acting compounder retracted.
FIG. 7 is an end elevation view, in section and not to scale, of the sealing interfaces of the movable seal assembly with the sealing interface of the other end of the apparatus overlaid in dotted lines for clarity.
FIG. 9 is an end elevation view, in section and not to scale, of the relative cross-sectional areas of the movable seal assembly (denoted in solid lines) and the equalization piston (denoted in dotted lines). The inner mandrel and outer housing are omitted for clarity.

Referring to FIGS. 1*a-c*, apparatus 10 may comprise a movable seal assembly 34, for example a piston as shown, disposed within the fluid chamber 16. Assembly 34 has a first end 42 that defines the downhole end 20 of the fluid chamber 16. This orientation may be reversed so that first end 42 defines the uphole end 18. Referring to FIGS. 2*a-c* and 3*a-c*, inner mandrel 14 and outer housing 12 have an outer shoulder 36 and inner shoulder 38, respectively, for contacting a second end 40 of the assembly 34. Referring to FIGS. 1*a-c*, outer shoulder 36 of inner mandrel 14 is designed to contact second end 40 to move the movable seal assembly 34 with the inner mandrel 14 when the inner mandrel 14 moves in a first direction relative to the outer housing 12 to compresses fluid within the fluid chamber 16. Relative movement in the first direction is demonstrated by envisioning the apparatus 10 moving from the configuration of FIGS. 1*a-c* to the configuration of FIGS. 2 *a-c*. Similarly, inner shoulder 38 of outer housing 12 is designed to contact second end 40 to prevent the movable seal assembly 34 from moving with inner mandrel 14 when the inner mandrel 14 moves in a second direction relative to the outer housing 12 to compresses fluid within the fluid chamber 16. Relative movement in the second direction is demonstrated by envisioning the apparatus 10 moving from the configuration of FIGS. 1*a-c* to the configuration of FIGS. 3 *a-c*. FIGS. 2*a-c* illustrate inner mandrel 14 being extended upwardly relative to outer housing 12 from neutral, in which case inner shoulder 36 moves assembly 34 with inner mandrel 14. FIGS. 3*a-c* illustrate inner mandrel 14 being retracted downwardly relative to outer housing 12 from neutral, in which case outer shoulder 38 prevents assembly 34 from moving with inner mandrel 14. In both cases, fluid above first end 42 and in fluid chamber 16 is compressed. Thus, compounding action occurs in both directions.

Referring to FIGS. 1*a-c* the movable seal assembly 34 may define an outer sealing interface 74 with the outer housing 12 and an inner sealing interface 76 with the inner mandrel 14. In addition, the uphole end 18 may comprise a sealing interface 78 between the inner mandrel 14 and outer housing 12 that defines a cross-sectional area that is greater than the cross-sectional area defined by the inner sealing interface 76 and less than the cross-sectional area defined by the outer sealing interface 74. In embodiments where movable seal assembly 34 is positioned at uphole end 18, sealing interface 78 is located at downhole end 20. Referring to FIG. 7, the interface 78 is conceptually illustrated as overlaid on interfaces 74, and 76 to demonstrate that interface 78 defines a cross-sectional area that is greater than the cross-sectional area defined by the inner sealing interface 76 and less than the cross-sectional area defined by the outer sealing interface 74. The cross-sectional areas are understood to be defined perpendicular to the central axis 80 of the apparatus 10, between the interface and the axis 80 itself. Referring to FIGS. 3*a-c*, in the context of an annular fluid chamber 16, the relative differences between cross-sectional areas of interfaces 74, 76, and 78 can be understood by reference to the lengths of respective interface diameters 75, 77, and 79 as shown. The relative arrangement of interfaces 74, 76, and 78 described above allows compression to occur in chamber 16 regardless of the direction of movement between mandrel 14 and housing 12 when movable seal assembly 34 is incorporated.

Figure 6:
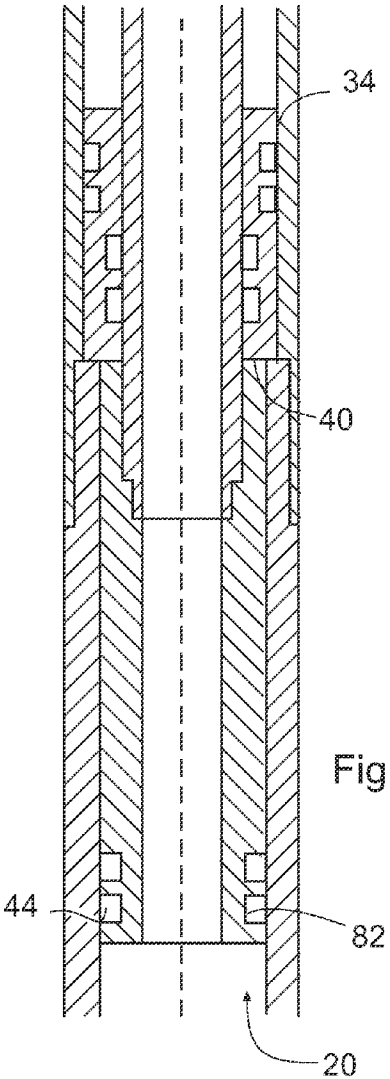
FIG. 6 is a side elevation view, in section and not to scale, of the movable seal assembly of a double-acting compounder that incorporates a vacuum chamber in use.

Referring to FIGS. 1*a-c* and 4, apparatus 10 may be configured to expose the second end 40 of the movable seal assembly 34 to toolbore pressure in use. Toolbore pressure is understood to be the fluid pressure in a longitudinal bore 35, such as a central bore as shown, of apparatus 10. In some cases toolbore pressure may equal wellbore pressure, which is understood to be the hydrostatic pressure of the wellbore surrounding the apparatus 10 in use. To expose second end 40 to toolbore pressure, no seals may be provided between second end 40 and bore 35. Referring to FIG. 6, in a contrasting embodiment, assembly 34 may be isolated within fluid chamber 16 between seals at uphole and downhole ends 18 and 20. The seal closest to the assembly 34 of such an embodiment is illustrated as seal 44. In this embodiment, when relative movement occurs from neutral between inner mandrel 14 and outer housing 12, a vacuum chamber (not shown) develops beyond second end 40 of assembly 34 and seal 44. In contrast, the embodiment of FIG. 4 forms no such vacuum chamber in use, thus reducing the risk of tool collapse under downhole conditions.

Figure 5:
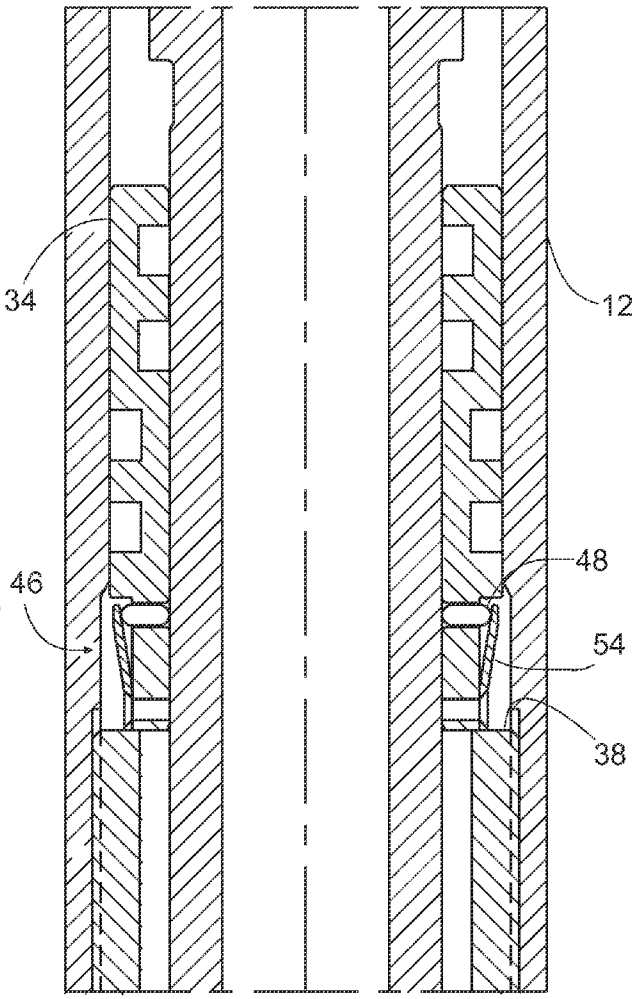
FIGS. 4 and 5 are side elevation views, in section and not to scale, of the movable seal assembly of the compounder of FIGS. 1*a-c*, illustrating the operation of the locking mechanism.
Figure 4:
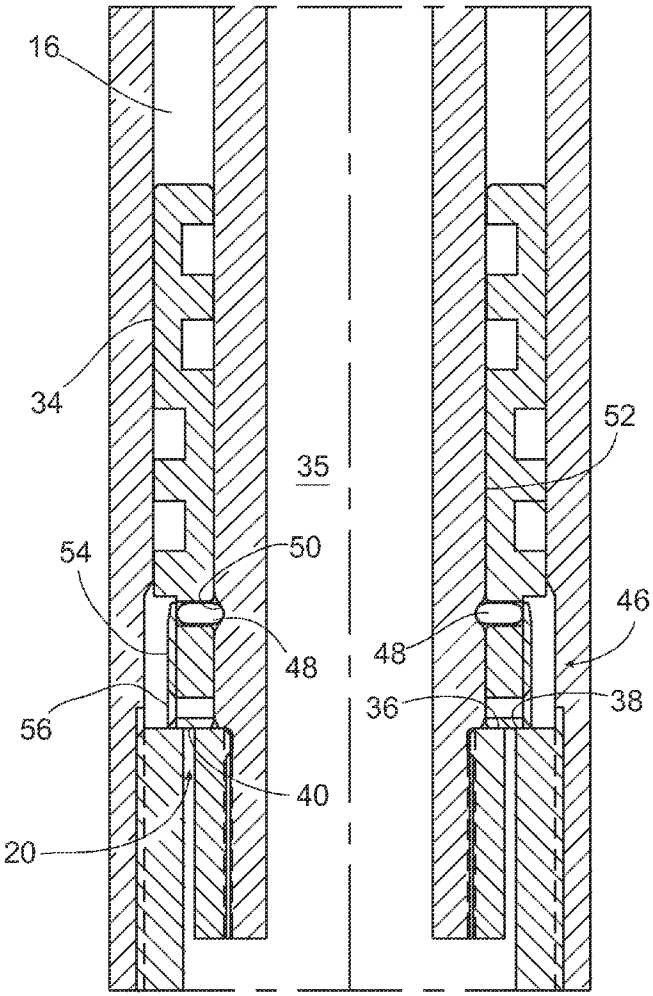

Referring to FIG. 4, apparatus 10 may comprise a restrictor, such as a lock 46, for restricting initial movement of the movable seal assembly 34 from both the inner shoulder 38 and the outer shoulder 36 due to hydrostatic pressure when the compounder is in a neutral position. The restrictor allows the equalization piston 30 to be displaced by wellbore pressure before or instead of assembly 34. The restrictor may comprise a type of mechanical lock 46 configured to release when a force above a lock threshold force is applied against the second end 40 of movable seal assembly 34 by one or more of shoulders 36 and 38. Lock 46 may comprise a pin 48 biased towards engagement with an indent 50 that is positioned to align and engage with the pin 48 at least when the compounder is in a neutral position, for example as shown in FIG. 4. Pin 48 may be mounted on the assembly 34 and the indent 50 may be positioned on one or both of the inner mandrel 14 and outer housing 12. Indent 50 may be located in a surface 52, which may be located on inner mandrel 14 or outer housing 12. One or more of the indent 50 and pin 48 may be beveled, for example smoothly curved as shown, to facilitate disengagement upon application of above threshold force. Referring to FIG. 5, the lock 46 is illustrated in a disengaged position, which has resulted from inner shoulder 38 of outer housing 12 contacting assembly 34 to prevent assembly 34 from moving with inner mandrel 14 during downward movement of inner mandrel 14. As shown, lock 46 may comprise an extension of assembly 34. Referring to FIGS. 4 and 5, pin 48 may be biased by a flat spring arm 54, although any suitable biasing mechanism may be used, such as a coil spring. Spring arm 54 may be held in place by screw 56. Other suitable restrictors may be used, such as a restrictive tolerance between assembly 34, mandrel 14, and housing 12 when apparatus 10 is in a neutral position. The use of a restrictor is advantageous as it restricts assembly 34 from being displaced by large external pressures, such as wellbore pressure, on second end 40 when apparatus 10 is in a neutral position. As disclosed the restrictor allows equalization piston 30 to be displaced before or instead of assembly 34 in order to equalize pressure and preserve the amount of stroke as is discussed below in further detail.

Referring to FIGS. 1*a-c*, apparatus 10 may have a first fluid fill port 58 into the fluid chamber 16 and a second fluid fill port 59 into the fluid chamber 16. Port 58 is illustrated as being located at uphole end 18. The extension 22 may be located between the first fluid port 58 and the second fluid port 59 as shown. The extension 22 may be configured so that a fluid chamber end 60 of the chamber 24 opens into the fluid chamber 16 in a direction facing the first fluid fill port 58. This allows fluid applied into fluid chamber 16 through second fluid fill port 59 to displace air bubbles from equalization chamber 89. This technique uses first fluid fill port 58 as a vent, and may be carried out as follows. First, the apparatus 10 is tilted so that first fluid fill port 58 is oriented at the highest point in the fluid chamber 16. Next, fluid is applied into chamber 16 through second fluid fill port 59, for example using a hand pump threaded into port 59. When fluid begins to come out of port 58, the apparatus 10 is shaken or bumped with a hammer to dislodge residual air bubbles in chamber 16. Next, port 58 is sealed, for example by threading in a sealing plug (not shown). More fluid is then supplied through port 59, in order to force movable seal assembly 34 into the neutral position in contact with shoulders 36 and 38. At this stage, equalization piston 30 will also be forced towards port end 84 of chamber 24. Thus, if it is desired to have piston 30 spaced from port end 84 at ambient conditions, a tool such as a wrench may be inserted into chamber 24 through port 26 in order to hold piston 30 at the desired spacing from port end 84 while chamber 16 is filled. As discussed below, spacing piston 30 from port end 84 allows piston 30 to compensate for thermal expansion of fluid in chamber 16 in a hot downhole environment. When chamber 16 is filled, port 59 is then sealed. The apparatus 10 may then be tested for leaks and pressure capacity.

Referring to FIGS. 1*a-c*, 2*a-c* and 3*a-c*, the operation of an example of apparatus 10 as a double-acting compounder will now be described. Referring to FIGS. 1*a-c*, apparatus 10 is shown in a neutral position, with shoulders 36 and 38 abutting second end 40 of assembly 34. The wellbore pressure of a downhole environment has moved piston 30 through chamber 24 into the position shown because piston 30 is unrestricted to move in response to wellbore pressure so as to equalize fluid chamber 16 pressure with wellbore pressure. The lock threshold force required to open lock 46 has not been overcome by the pressure in the wellbore, and thus assembly 34 remains abutted against shoulders 36 and 38. In some embodiments, apparatus 10 may be configured so that at ambient temperature and pressure conditions piston 30 is spaced at an intermediate location of travel along chamber 24, for example in the location as shown. Thus, if apparatus 10 is then disposed into a hot downhole environment in which fluid in fluid chamber 16 expands, piston 30 can travel in the direction toward port end 84 of chamber 24 in order to prevent overpressurization in fluid chamber 16 in the neutral position. Thus, equalizer 21 allows fluid chamber 16 to equalize pressure with relatively lower or higher external pressures.

When an operator requires intensifying jarring action in the uphole direction, a tensile load is applied to the coil tubing string. As soon as relative upward movement of mandrel 14 occurs, outer shoulder 36 contacts and moves assembly 34 with the inner mandrel 14 while fluid located above first end 42 of assembly 34 is compressed. Referring to FIGS. 2*a-c*, this compression then causes equalization piston 30 to gradually migrate along extension 22 towards port 26, eventually reaching port end 84 of chamber 24. As mandrel 14 extends relative to housing 12, pressure builds within fluid chamber 16, until the built up force is released by the action of the jar, and the mandrel 14 is biased back into the neutral position shown in FIGS. 1*a-c*.

Referring to FIGS. 1*a-c*, from neutral either an intensified upjar or downjar action can be carried out. If an intensified downjar is desired, a compressive force is applied to the coil tubing string, forcing mandrel 14 to retract into housing 12. Referring to FIGS. 3*a-c*, the response of equalization piston 30 in an intensified downjar action is analogous to the response observed during an intensified upjar action, in that the piston 30 is gradually biased towards port end 84 of chamber 24. The lock threshold force of lock 46 must be overcome by inner shoulder 38 in order to pop pin 48 out of engagement with indent 50 to allow shoulder 38 to prevent the assembly 34 from moving with the inner mandrel 14 as shown. As mandrel 14 retracts into housing 12, pressure builds within fluid chamber 16 until the built up force is released again by the action of the jar. The compounder is then biased back into the neutral position shown in FIGS. 1*a-c*. The compounder may be designed to ensure that movable seal assembly 34 always returns to neutral after an intensifying jar action has been carried out in which the assembly 34 has been unlocked. Referring to FIG. 9, this may be accomplished by providing equalizer piston 30 with a cross-sectional area that is smaller than the cross-sectional area of movable seal assembly 34. The cross-sectional area of the equalizer piston 30 is defined between the dotted lines, while the cross-sectional area of the movable seal assembly 34 is defined between the solid lines. Referring to FIGS. 1*a-c*, another way of accomplishing this is to spring-bias equalizer piston 30 away from port end 84 of chamber 24.

Figure 8:
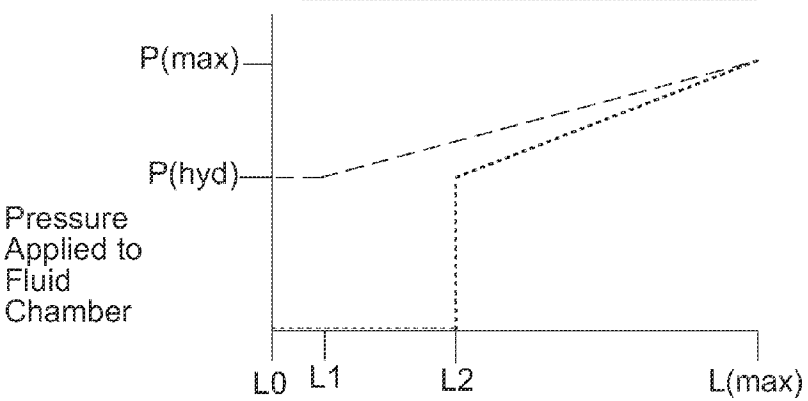
FIG. 8 is a graph of the pressure applied to the fluid chamber vs. the stroke distance from neutral for various compounder embodiments.

Referring to FIG. 8, a graph is provided for illustrating the distinction between compounders with and without equalizer 21. It should be noted that hydrostatic pressure P(hyd) will be different depending on the depth of apparatus 10 in the well, among other factors. With equalizer 21 present, fluid chamber 16 remains at hydrostatic pressure P(hyd) from stroke L0 to L1, and then experiences a smooth pressure buildup from L1 to the maximum stroke distance L(max). By contrast, with no equalizer 21 present, a substantial distance L2 of stroke must be traveled before an abrupt pressurization to P(hyd) occurs. Referring to FIGS. 1*a-c*, the effect of having no equalizer 21 can be envisioned by considering the forces that assembly 34 will be under in the absence of equalizer 21. As apparatus 10 descends into the well and wellbore pressure rises, a pressure differential is created across assembly 34 that displaces assembly 34 a distance away from shoulders 36 and 38 in order to equalize the pressure. This separation must be bridged by the respective shoulder 36 or 38 in an intensifying jar action before substantial pressure buildup can occur. Referring to FIG. 8, once assembly 34 is contacted by shoulders 36 or 38 at stroke distance L2, rapid and abrupt pressure-up to the hydrostatic wellbore pressure occurs. By contrast, fitting the compounder with equalizer 21 affords greater length of power stroke, by avoiding losses from the effect of hydrostatic pressure on the movable seal assembly 34. The graph also illustrates that a compounder with equalizer 21 may actually pressure up at a shallower rate of pressure increase over a longer stroke distance (L1–L(max)) as opposed to a compounder without equalizer 21, which pressures up over a shorter stroke distance (L2–L(max)).

Referring to FIGS. 1*a-c*, equalization piston 30 and chamber 22 may be annular in shape, although this is not required. Similarly, assembly 34 may be annular in shape although this is not required. In some embodiments, there may be one or more fluid chambers 16, each one operating according to the embodiments disclosed herein. Plural pistons 30 or 34 may also be employed. Either or both of inner mandrel 14 and outer housing 12 may be individually composed of, for example, one or more units connected together. Each unit may be, for example, threadably connected together as illustrated in the figures. For example, referring to FIGS. 1*a-c*, outer housing 12 may further comprise a first sub 62 connected to a second sub 64. The first sub 62 may comprise the extension 22, the extension 22 may define an outwardly facing surface 66 of the chamber 24, and the second sub 64 may define an inwardly facing surface 68 of the chamber 24. The first sub 62 may also be a connector sub connected between second sub 64 and a third sub 65, Thus, the complex structure of equalizer 21 may be created by assembly of simpler constituent parts. A clearance 19 is provided between extension 22 and inner mandrel 14 that is sufficient to allow fluid to flow through, for example during filling of chamber 16 or relative movement between mandrel 14 and housing 12. The size of clearance 19 may be selected in order to reduce restriction to fluid flow, with clearance 19 being greater than a close tolerance fit.

Outer housing 12 and inner mandrel 14 may be, for example, tubulars. In the embodiment illustrated in FIGS. 1*a-c*, in a downhole application, inner mandrel 14 may be connected, directly or indirectly, to a coil tubing string (not shown), whereas outer housing 12 may be connected, directly or indirectly, to, for example, a fishing tool (not shown). This orientation may be reversed. It should be understood that apparatus 10 can be oriented upside down in a well, and still carry out the intended function of the apparatus. In addition, in some embodiments extension 22 may be positioned on inner mandrel 14 with a port (not shown) to the toolbore.

As indicated above, the apparatus 10 disclosed herein may be used with coil tubing. The compounder shown is advantageous for coil tubing operations, because it is adapted to deliver compressive enhancements in either direction, within a tool length that may be shorter than other double-acting compounders. The apparatus 10 may be part of a jar.

Referring to FIGS. 1*a-c*, splines 70 and 72 may be provided on mandrel 14 and housing 12, respectively, in order to transmit torque by restricting relative rotation between mandrel 14 and housing 12. Floating seals (not shown) may be used to seal one or more of uphole and downhole ends 18 and 20 in apparatus 10. Referring to FIG. 6, a seal as discussed in this application may be achieved by a suitable sealing mechanism, such as a seal composed of an annular groove 82 and a corresponding o-ring (not shown).

Apparatus 10 disclosed herein may be used in, for example, fishing operations, drilling operations, coil tubing, and drill strings. The use of up or down in this document illustrates relative motions within apparatus 10, and is not intended to be limited to vertical motions, or upward and downward motions. It should be understood that apparatus 10 may be used in any type of well, including, for example, vertical, deviated, and horizontal wells.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A double-acting compounder, comprising:

an outer housing;

an inner mandrel at least partially disposed telescopically within the outer housing to define a fluid chamber between the inner mandrel and the outer housing, the fluid chamber containing fluid and being sealed at an uphole end and a downhole end;

a port extending through the outer housing and communicating between the fluid chamber and an exterior of the outer housing that, in operation is subject to hydrostatic pressure outside the outer housing;

an equalizer, in contact with fluid from the fluid chamber, between the fluid chamber and the port for equalizing pressure between the fluid chamber and the hydrostatic pressure outside the outer housing at least when the double-acting compounder is not compounding;

a movable seal assembly disposed within the fluid chamber and having a first end that defines the uphole end or the downhole end of the fluid chamber;

the inner mandrel having an outer shoulder for contacting a second end of the movable seal assembly to move the movable seal assembly with the inner mandrel when the inner mandrel moves in a first direction relative to the outer housing to compresses fluid within the fluid chamber; and the outer housing having an inner shoulder for contacting the second end of the movable seal assembly to prevent the movable seal assembly from moving with the inner mandrel when the inner mandrel moves in a second direction relative to the outer housing to compresses fluid within the fluid chamber.

2. The double-acting compounder of claim 1 in which the equalizer comprises an equalization piston, and in which the double-acting compounder further comprises a restrictor for restricting initial movement of the movable seal assembly from both the inner shoulder and the outer shoulder due to hydrostatic pressure when the double-acting compounder is in a neutral position.

3. The double-acting compounder of claim 2 in which the restrictor comprises a lock configured to release when a force above a lock threshold force is applied against the second end of the movable seal assembly by one or more of the inner shoulder and the outer shoulder.

4. The double-acting compounder of claim 3 in which the lock comprises a pin biased towards engagement with an indent that is positioned to align and engage with the pin at least when the double-acting compounder is in the neutral position.

5. The double-acting compounder of claim 4 in which the pin is mounted on the movable seal assembly and the indent is positioned on one or both of the inner mandrel and outer housing.

6. The double-acting compounder of claim 2 in which the equalizer further comprises an extension from the outer housing into the fluid chamber between the downhole end and the uphole end to define a chamber between the extension and the outer housing, the chamber having the port, and in which the equalization piston is disposed within the chamber between the fluid chamber and the port.

7. The double-acting compounder of claim 6 further comprising a first fluid fill port into the fluid chamber and a second fluid fill port into the fluid chamber, and in which the extension is configured so that a fluid chamber end of the chamber opens into the fluid chamber in a direction facing the first fluid fill port.

8. The double-acting compounder of claim 7 in which the extension is between the first fluid port and the second fluid port.

9. The double-acting compounder of claim 6 in which the equalization piston and the chamber are annular in shape.

10. The double-acting compounder of claim 6 in which the outer housing further comprises a first sub connected to a second sub, and in which the first sub comprises the extension.

11. The double-acting compounder of claim 1 configured to expose the second end of the movable seal assembly to toolbore pressure in use.

12. The double-acting compounder of claim 1 for use with coil tubing.

* * * * *